United States Patent [19]

Curatolo

[11] Patent Number: 4,593,508

[45] Date of Patent: Jun. 10, 1986

[54] EXTRUSION

[76] Inventor: Frank Curatolo, 130 Overlook Ave., Hackensack, N.J. 07601

[21] Appl. No.: 722,061

[22] Filed: Apr. 11, 1985

[51] Int. Cl.[4] ..... E05D 15/56

[52] U.S. Cl. ..... 52/239; 52/281; 52/586; 52/36; 403/170

[58] Field of Search ..... 52/239, 238.1, 281, 52/582, 584, 586, 585, 36; 402/170, 406

[56] References Cited

U.S. PATENT DOCUMENTS

Re. 31,733 11/1984 Haworth et al. ..... 52/239 X 3,605,851 9/1971 Miles et al. ..... 52/239 X 4,223,500 9/1980 Clark et al. ..... 52/584 X 4,269,005 5/1981 Timmons ..... 52/239 X

*Primary Examiner*—Carl D. Friedman

*Assistant Examiner*—Naoko N. Slack

*Attorney, Agent, or Firm*—Bauer & Amer

[57] ABSTRACT

One or more panels of similar construction are formed having a frame on a pair of planar decorative faces are secured. The frame is provided with a centrally located groove in its peripheral edges. One or more connecting bars are provided each having plate-like projections fitting into the grooves. The frames and bars are provided with cooperatively engaging means for removably interlocking the panels and the bars together.

2 Claims, 10 Drawing Figures

EXTRUSION

BACKGROUND OF THE INVENTION

The present invention relates generally to room partition assemblies and more particularly to the structutre of partition panels and support members for dividing rooms or forming spatial barriers.

Partition panel installations are known for forming temporary rooms and removable walls, barriers, and the like. Similarly formed partitions are attached end to end or perpendicularly to each other in T or box-shape to form any number of divided configurations. In my earlier U.S. Pat. No. 4,090,335 issued May 23, 1978, a system was disclosed in which the edges of the panels were fit with Velcro fastening means so that end to end, box-shape or T-shape installations may be made wherein the edge is in fixed abutment with the face of another panel.

Prior thereto, such panels were joined together by rigid connecting bars, which held the panels together and also enable the panels to be secured to the floor, walls and ceiling to provide a fixed non-movable installation. In such installations special clips, bolts or other fastening means, requiring manual installations with the use of tools were required to secure the panels to the connecting bars. In the first instance installations attached to the ceiling or floor could not be made; while in the second instance even though such installations were possible the labor costs due to the time necessary to install bolts and the like have tended to make them prohibitive.

It is an object of the present invention to provide an improved partition and supporting post assembly combination overcoming the shortcomings of the prior art.

Specifically, it is the object of the present invention to provide a room partition assemblies where partition panels of similar construction and connecting bars are substantially self-securing and do not require the use of tools, fasteners, bolts, or the like for assembly.

It is a further object of the present invention to provide a partition panel and support post combination which permits installation in a variety of decorative and advantageous shapes, cheaply and quickly.

The foregoing objects and advantages together with others will be apparent from the following disclosure of the present invention.

SUMMARY OF THE INVENTION

According to the present invention, an improved room partition assembly is provided comprising one or more panels of similar construction and formed of a frame having a pair of planar decorative faces and a polygonal peripheral outline (preferably rectangular) in which a centrally located groove is formed in its peripheral edges and one or more connecting bars each having tongue-like projections fitting into the grooves. The frames and bars are provided with cooperatively engaging means for removably interlocking the panels and the bars together.

The connecting bars are shaped in cruciform or simple cross in transverse section, wherein the bar forms a base member, to which a pair of perpendicularly extending tongues is formed. The tongues are provided with hook-like recess uniformly spaced along its length. The panels are provided with dowels, extending across the width of the peripheral grooves and spaced from each other in conformance with the spacing of the hook on the supporting bars.

The base member itself has an H-shaped transverse section, being bifurcated along each of its opposite longitudinal edges to provide a pair of spaced flanges about a continuous slot slightly larger in dimension than the thickness of the tongue. Spaced uniformly along the length of each slot in conformity to the spacing of the hooks are a plurality of dowel retainers, similar to those formed in the panels. In addition the surfaces of the slots are provided with means enabling the securement of threaded fastners or the like thereto.

Thus, the panels may be removably attached to the supporting posts directly in end to end relationship and by combining supporting posts in T, box or angular relationship.

Full details of the present invention are set forth in the following description and are illustrated in the accompanying drawings.

DESCRIPTION OF THE INVENTION

Figure 1:
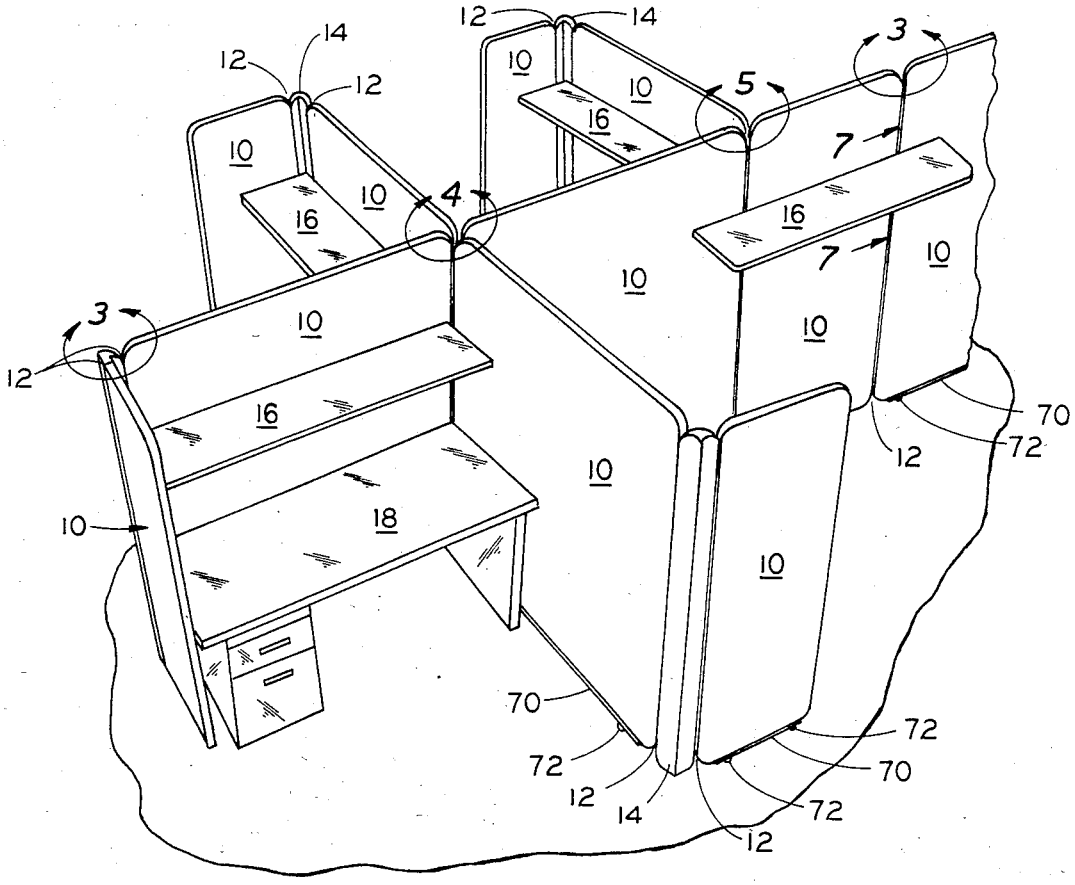
FIG. 1 is a perspective view of several panels and supporting posts, embodying the present invention, arranged in several room and partition configurations.

FIG. 1 depicts several typical room or partition arrangements capable of being formed with the present invention. In such arrangement panels are situated end to end or perpendicularly to each other to form complete rooms, cubicals or mere partitions. In addition, shelves, tables and other auxilliary structures and arrangements obvious to the reader can be formed. Each arrangement is carried out using one or more panels, generally depicted by the numeral 10 in combination with one or more connecting members, generally depicted by the numeral 12. Vertical floor posts 14, to support free standing panels particularly at the corners, are also used. The shelves 16, table tops 18 and the like may also be supported on the connecting bar members.

Figure 2:
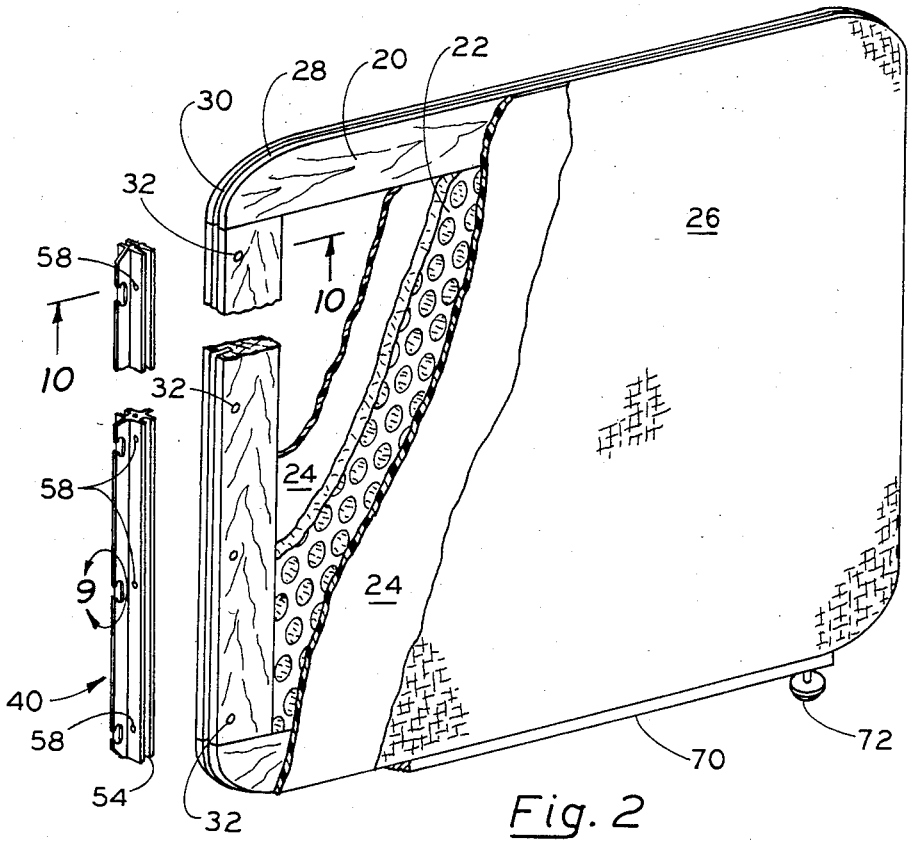
FIG. 2 is an exploded view, partially in section, of a panel and supporting posts embodying the present invention.

As seen in FIG. 2, each panel 10 is formed of a peripheral frame 20, preferably rectangular, although other polygonal shapes can be made. The frame may be made of wood, aluminum or plastic. The interior of the frame 20 is filled with a sheet of bubble plastic 22 for reduced weight, but of high thermal and noise insulation. The plastic sheet 22 and the frame 20 is covered on each face with flat face sheet 24 preferably of composition material, hardboard or the like, over which is tightly stretched a fabric cover sheet 26 of decorative material.

The peripheral outer edges 28 of the frame 20 is provided with a continuous centrally located groove 30, into which the edges of the fabric cover are inserted and fastened as by gluing or the use of other adhesive system so that the fabric edges are hidden. The groove 30 has a width sufficient, so that after insertion of the fabric, there remains sufficient space for the insertion therein of the hooked tongue members formed on the connecting post, as will be later described.

The panel as described up to this point is similar to the basic panel described in my aforementioned U.S. Pat. No. 4,090,335 to which further reference can be made, if necessary. In the aforementioned patent, the continuous groove is filled with a T-shaped molding strip over which is adhered a Velcro-fastening strip. The panel here makes no primary use of the Velcro strip nor its T-shaped molding, but provides entirely different means for interconnecting the panels. It is to be understood, however, that the basic construction of the panel is not immutable, and such features as the interior sheets and fabric covering can be easily modified. It is necessary, however, to provide a panel having the continuous groove about its peripheral edges.

Figure 10:
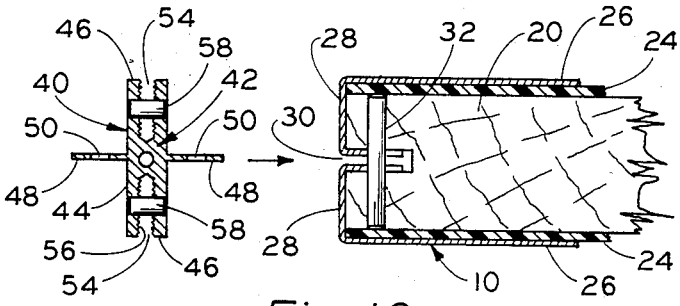
FIG. 10 is a sectional view taken along line 10—10 of FIG. 2.

As seen in detail in FIG. 10, the panel is completed in accord with the present invention by providing it with a plurality of dowels 32 extending through the peripheral frame adjacent its edge 28 so as to traverse the groove 30, perpendicularly thereto. The dowels 32 are uniformly spaced from each other and from the edge 28. They may be made of wood, aluminum, or other material, and may be force fit or otherwise secured in place in the frame.

Turning back to FIG. 2, the connecting bar comprises an elongated cruxiform extrusion 40, preferably of aluminum because of ease of manufacture, lightness for transportation and strength in use. However, the connecting bar may be formed of wood, or be a plastic extrusion if desired.

Figure 9:
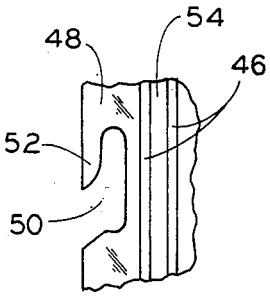
FIG. 9 is enlarged view of the portion included by the arrow 9 of FIG. 2 showing the connecting bar hook.

The connecting bar 40 comprises an integral arrangement of an elongated base 42 having flat sides 44 and narrow longitudinal edges 46. Perpendicularly to each of the flat sides 44 is an elongated tongue 48, adapted for insertion into the groove 28 of the panel. As seen in FIGS. 2 and 9, each of the tongues is provided with a plurality of shaped slots 50 forming a hook 52. The slots 50 are shaped so as to pass over respective dowels 32 in the panels 10, allowing the hooks 52 to seat thereover and hold the panel to the bar. The slots 50 are spaced along the respective tongue 48, conformingly to the spacing of the dowels 32 so that all of the dowels 32 on a given side of the panels can simultaneously be hooked onto the associated bar, within the length of the bar.

Figure 4:
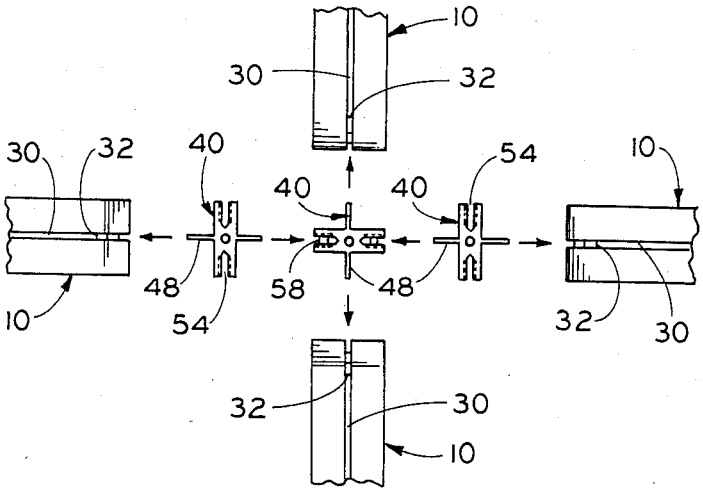
FIG. 4 is a view similar to FIG. 3 illustrating four panels arranged perpendicular to each other as encircled by the arrow 4 in FIG. 1.
Figure 5:
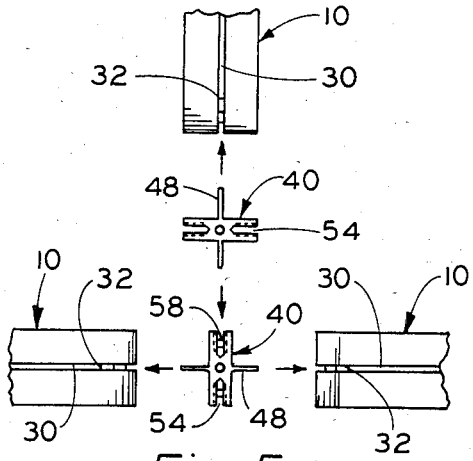
FIG. 5 is a view similar to FIG. 4 showing the arrangement of three panels perpendicular to each other encircled by the arrow 5 in FIG. 1.
Figure 7:
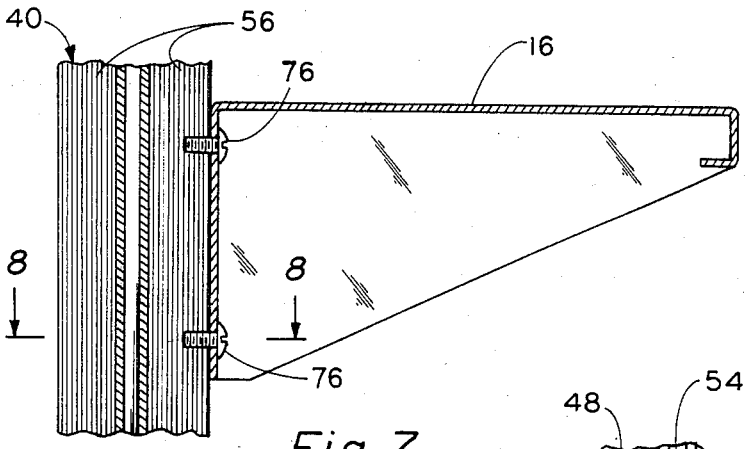
FIG. 7 is a vertical section through a connecting bar showing the attachment thereto of a shelf bracket.

The connecting bar 40 is further provided with elongated channels 54 in each of the longitudinal edges 46 of the base 42. The walls of the channels 54 are proided with a plurality of parallel striations 56 or narrow flutes as seen in FIG. 7, enabling the fastening of thereto of threaded members. In addition, the channels 54 are traversed by a plurality of pins 58, which are similar to and serve the same function as the dowels 32 in the panel, and which are therefor spaced conformingly thereto and to the slots 50 in the tongues 48. In this manner, two or three bars 40 can be connected together to form T or box connections as seen in FIGS. 4 and 5.

Figure 3:
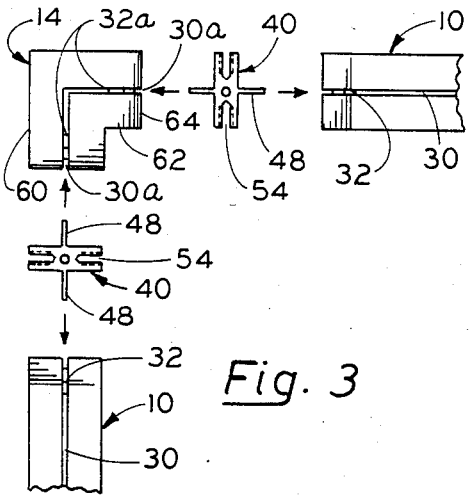
FIG. 3 is an exploded plan view partially in section illustrating the corner arrangement of partitions and posts encircled by the arrow 3 in FIG. 1.

The panels and connection of the present invention may be supplemented by auxiliary components to provide a more complete installation. For example, vertical floor engaging support posts 14 may be employed which for decorative purposes are elongated members having an L-shaped cross sections in block form, the outer and inner faces 60 and 62 respectively being decorated or plain. That is, they are not channelled or sloted unless it is part of the decoration. The longitudinal non-contigious edges 64, however, are formed with a groove **48*a* and a plurality of transverse dowels 32*a* which conform in all manner to the structure and function of grooves 48 and dowels 32 heretofore described. Thus, the floor engaging posts may be connected to a connecting bar 40 which is in turn connected to a panel 10 as illustrated in FIG. 3**.

Another component, if desired, is seen in FIGS. 1 and 2. This component comprises a footing 70 which is securable to the lower edge of the panel when put in place. The footing 70 is formed as a plain bar and is provided with a tongue, not seen in the drawing, on only one face. The unseen tongue is provided with slots and hooks such as those slots 50 and hooks 52 earlier described so that securement to the panel may be made in the same manner.

Both the posts 14 and footings 70 can be provided with screw adjusting leveling pads 72.

While not shown in the drawings, the panels may be decoratively completed by inserting into the peripheral grooves a molding strip, such as shown in my aforementioned patent, with or without the Velcro. The molding rather than having tongues with hooks may have simple discontinuous tongues, retaining pins, or the like which force fit into those peripheral grooves not inter engaged with connecting bar.

Figure 6:
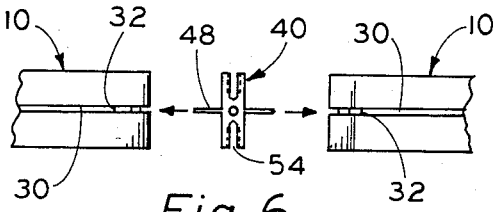
FIG. 6 is yet another exploded plan view identifying the arrangement of two panels end to end as encircled by the arrow 6 in FIG. 1.

As earlier discussed, the present invention can be employed to produce various configurations some of which have already been described. In summary, FIG. 3 shows an arrangement for a corner connection using a supporting post 14, a pair of connecting bars 40 and a pair of panels assembled, following the arrows in the Figure, to the bars. In FIG. 4, four panels 10 are interconnected employing a central connecting bar, to which two additional connecting bars are assembled, also following the assembly indicated by the arrows. In FIG. 5, a T-configuration is shown employing only two connecting bars and three panels. Lastly, in FIG. 6, an end to end arrangement employing a single connecting bar and two panels is shown.

Figure 8:
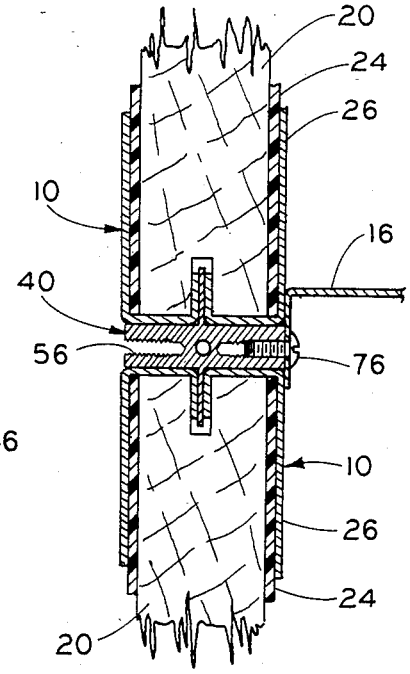
FIG. 8 is a sectional view taken along line 8—8 of FIG. 7.

As seen in FIG. 8, the connecting bar with its flat faces and a width equal to the thickness of the panel 10 permits the panels to abut the connecting bar flush without any space, so that a firm interlocking of the panels and bar is effective. Further, the hooks 52 hold the panels taut, preventing shifting, wobbling, or dislodgement of the panels. In addition, the connecting bar secures the fabric covering 26 firmly in place so that handling of the panel or touching of the fabric will not loosen it. Also, because of the continuity afforded by the connecting bar and the adjacent panels, integrity of the sound and thermal insulation is maintained in the assembled panels.

FIGS. 7 and 8 further illustrates the ease in which auxiliary furniture members such as shelves, tables, lamps etc., may be installed, simply by fastening such members to the connecting bars using ordinary metal screws 76 which thread into the striated surface of the channels 54.

Various other features are contained in the present disclosure and various modifications and changes have been disclosed. Other such modifications and charges will be apparent to those skilled in the art. Therefore the present disclosure is not intended to limit the scope of the invention.

What is claimed is:

1. An assembly comprising in combination one or more similarly constructed partition panels secured to one or more similarly constructed connecting members for subdividing the area of a room into smaller configurations, each of said partition panels having a peripheral edge in which a groove is centrally located, each of said connecting members comprising an elongated bar having a first pair of opposed elongated outwardly extending tongues each being adapted to enter into said groove in the peripheral edge, said groove and said tongue being provided with cooperating means for removably inter-engaging said panel and bar on insertion of said tongue into said groove, and said each bar having a second pair of longitudinal edges extending perpendicularly of said tongues each having a channel formed therein and pin members extending transversely across said channels, said channel and pin members being adapted to receive and secure the tongue members of other similar constructed bars.

2. The assembly according to claim 1, wherein the surface of said channels are striated permitting threading of a screw fastener thereto.

* * * * *